United States Patent [19]

Yates et al.

[11] 3,963,370

[45] June 15, 1976

[54] LAUNDRY MACHINE BLOWER MECHANISM

[75] Inventors: Roy K. Yates; Charles T. Lutes, both of Louisville, Ky.

[73] Assignee: General Electric Company, Louisville, Ky.

[22] Filed: Oct. 16, 1974

[21] Appl. No.: 515,160

[52] U.S. Cl. ..... 415/199 A

[51] Int. Cl.[2] ..... F04D 1/02; F04D 17/12; F04D 29/44

[58] Field of Search ..... 415/199 R, 199 A, 199 T, 415/198, 104, 179, 140, 131, 198; 8/159; 68/20; 34/79

[56] References Cited

UNITED STATES PATENTS 796,721 8/1905 Heilmann ..... 415/199 A 1,667,992 4/1884 Sherwood et al. ..... 415/199 A

*Primary Examiner*—Martin P. Schwadron
*Assistant Examiner*—Robert J. Miller
*Attorney, Agent, or Firm*—Frederick P. Weidner; Francis H. Boos

[57] ABSTRACT

A combinaton washer-dryer laundry machine having a washing, extraction and drying operations. There is included in the machine a rotatable drum for tumbling the clothes, a liquid pump for removing liquid from the machine, a vacuum blower for extracting liquid, and a heater and blower to be utilized during the drying operation. The vacuum blower is structurally arranged to help reduce noise.

5 Claims, 4 Drawing Figures

LAUNDRY MACHINE BLOWER MECHANISM

BACKGROUND OF THE INVENTION

1. Field of the Invention

This invention relates to laundry machines, particularly such machines that are combination washer-dryers and particularly relates to the blower mechanism in such a machine.

2. Description of the Prior Art

Combination washer-dryers are machines which provide for complete laundering of clothes, that is, they provide a washing operation which includes washing and rinsing, a liquid extraction operation for removing a substantial part of the liquid from the clothes after wash operation, and a complete drying of the clothes, generally effected by tumbling the clothes in the presence of warm air. In some of these combination type laundry machines a centrifugal extraction operation by spinning the basket is used to remove most of the liquid from the clothes while in other the liquid is removed from the machine by means of suction. One such laundry machine of the latter type is shown in U.S. Pat. No. 3,050,975, assigned to the same assignee as the present invention, wherein after the washing operation is completed a substantial amount of suction is operative at the bottom of the drum as the drum is rotated and after the liquid content of the clothes has been brought down the regular heat drying operation is begun. That is, the clothes are tumbled in the rotating drum as warm air is circulated through the clothes.

Another combination washer-dryer is shown in U.S. Pat. No. 3,344,447 wherein after or during the clothes within the drum have been subjected to a washing operation vacuum is drawn on the drum through a plurality of peripheral passageways that are connected to the interior of the drum and the wash water is extracted, then vacuum and/or heated air continues to dry the clothes for the remainder of the drying operation.

On of the difficulties with the vacuum extraction type combination washer-dryer laundry machine is that the vacuum blower must be powerful enough to accomplish its extraction operation which in turn makes it rather noisy.

It is desirable to be able to have a combination washer-dryer laundry machine that will be efficient in operation, low in manufacturing cost, and economical to operate in order to make it desirable. Moreover, since laundry machines are to be used in places of residence it is highly desirable that the machine can be operated within minimum noise.

By our invention all of the above-described characteristics of a laundry machine may be achieved and in particular the last mentioned characteristic of reduced noise caused by the vacuum blower.

SUMMARY OF THE INVENTION

There is provided a laundry machine having a blower mechanism with a plurality of bladed rotatable blower wheels in axial alignment to produce an air flow. The improvement for the blower mechanism consists of providing the blower with a housing surrounding the blower wheels and having an air inlet directed at the center of the first axially aligned blower wheel, a peripheral walled circular chamber circumferentially around all of the blower wheels and having an air flow passageway leading from the last axially aligned blower wheel into said chamber and an air outlet perpendicular to the axis of rotation of the blower wheels for expelling air therefrom.

DESCRIPTION OF THE PREFERRED EMBODIMENT

Figure 1:
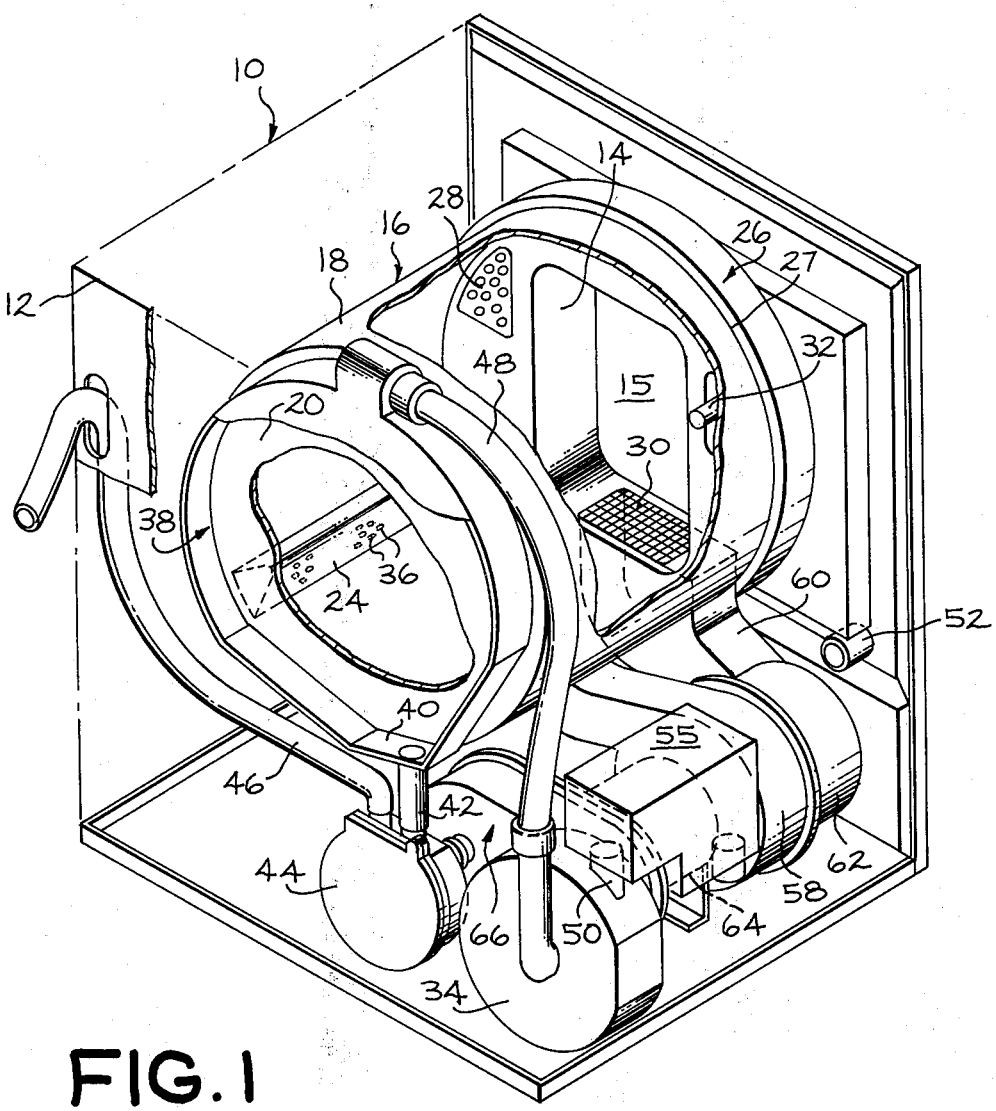
FIG. 1 is a partially cut away perspective of a combination washer-dryer laundry machine showing the arrangement of the various machine components and utilizing a vacuum blower mechanism to which this invention relates.

Referring now to the drawings and particularly to FIG. 1 thereof, there is illustrated a laundry machine 10 including an appearance and protective outer cabinet 12 having an access opening 14 into the interior of the cabinet for loading and unloading the clothes. A hinged door 15 that closes and seals the access opening when the machine is to be operated is also provided. Such laundry machines are provided with a manual control so that the operator by manually setting the control causes the machine to start and automatically proceed through a cycle operation including washing, extraction and drying operation. These controls are not shown or described herein as they are not necessary to understand the invention and they are well known in the trade to which this invention relates.

Within cabinet 12 there is provided a clothes tumbling container or drum 16 mounted for rotation about a horizontal axis. Drum 16 is cylindrcal in shape and has a central cylindrical wall portion 18 and a rear circular wall portion 20. Drum portions 18 and 20 are imperforate while the front of the drum is open and is accessible through the opening 14. Around the interior surface of cylindrical wall portion 18 there is a plurality of clothes tumbling ribs or baffles 24 so that clothes are lifted up when the drum rotates and then permitted to tumble back down to the bottom of the drum. These baffles also serve as part of the liquid extraction apparatus as will be discussed more fully later. The drum 16 is rotatably supported within the cabinet 12 by a central stub bearing axle that supports the drum at the center of the rear circular wall 20. The front of the drum is rotatably supported on a large circular component 26 which has the access opening 14. The front of the drum fits into a circular recess 27 in the component 26 and slidably rests on slide members (not shown) that allows the drum to rotate yet be retained in its proper position within the cabinet. The component 26 also contains the air inlet opening 28 that allows the air to flow into the drum 16. This large circular component 26 also has an air outlet opening 30 to allow air to be withdrawn from the drum. Also through the large circular component is a liquid inlet 32 in the form of a conduit that may be connected to a source of liquid exterior of the machine.

The following will be a general description of the apparatus utilized in the washing and extraction operations of the laundry machine and how the liquid is introduced and extracted from the clothes and the machine. Essentially the clothes are washed by placing them in the drum 16, closing the access door and manually setting the control that starts the laundry machine through its cycled operations. Liquid from outside the machine is introduced into the drum through liquid inlet 32. Once the clothes are saturated the liquid is withdrawn from the drum continuously through perforations 36 in baffles 24 as by a vacuum pressure system which system has a negative pressure produced by means of a vacuum blower 34 to which this improvement invention relates. As liquid within the drum starts to accumulate then suction caused by the vacuum pressure system through the vacuum blower 34 causes liquid and air to be drawn through perforations 36 in the baffle and into the interior of the baffles. By a transfer arrangement the air and liquid are transferred to a separator 38. The separator 38 is adjacent the rear circular drum wall 20 and substantially covers the entire wall 20. The air and liquid entering the separator 38 will be separated by providing a rather large chamber so that liquid is separated from the air by a combination of centrifugal force and gravity and accumulates at the bottom or reservoir portion 50 and is allowed to pass by conduit 42 into the liquid pump 44 so that the used liquid may be expelled from the machine by a drain hose 46. The air from within the separator 38 passes through hose 48 into the vacuum blower 34. The outlet 50 of the vacuum blower is connected to a muffler 55 to reduce the air noise before entering an exhaust port 52. As the clothes are being tumbled and the liquid is being introduced into the drum the vacuum system extracts the used liquid such that the amount of liquid removed is about the same as the amount of liquid being introduced. In this manner the clothes being washed are essentially sopping wet. The vacuum systems sucks the wash water from the drum, the liquid being separated in the separator and then removed from the machine by the liquid pump 44, while at the same time the entire system is under a negative pressure influence caused by the vacuum blower 34.

After a period of time the laundry machine control automatically stops the flow of incoming liquid to complete the washing operation and the extraction operation starts. The negative pressure continues for the extraction operation to thereby reduce the liquid retention of the clothes being washed while the drum is continued to be rotated. After the completion of the liquid extraction operation the drying operation takes place. This consists of the control automatically de-energizing the vacuum blower 34 and energizing a heating element (not shown) while the drum 16 is continued to be rotated and heated air is circulated by air blower 58 through the system. The heated air enters the drum through air inlet opening 28, passes through the clothes and leaves the drum by the air outlet opening 30, passing into an exhaust duct 60. The moisture-laden air leaving the drum may, as shown, be passed through a condenser unit 62 that causes the temperature of the air to be lowered thereby condensing out moisture from the air, then the air recirculated through the clothes again. Alternatively rather than passing the moisture-laden air through a condenser unit it may be expelled from the machine through suitable ducts.

To drive the driven components of the laundry machine there is provided an electric motor 64 and a transmission mechanism 66, the details of which are not necessary for the purposes of this invention.

Figure 2:
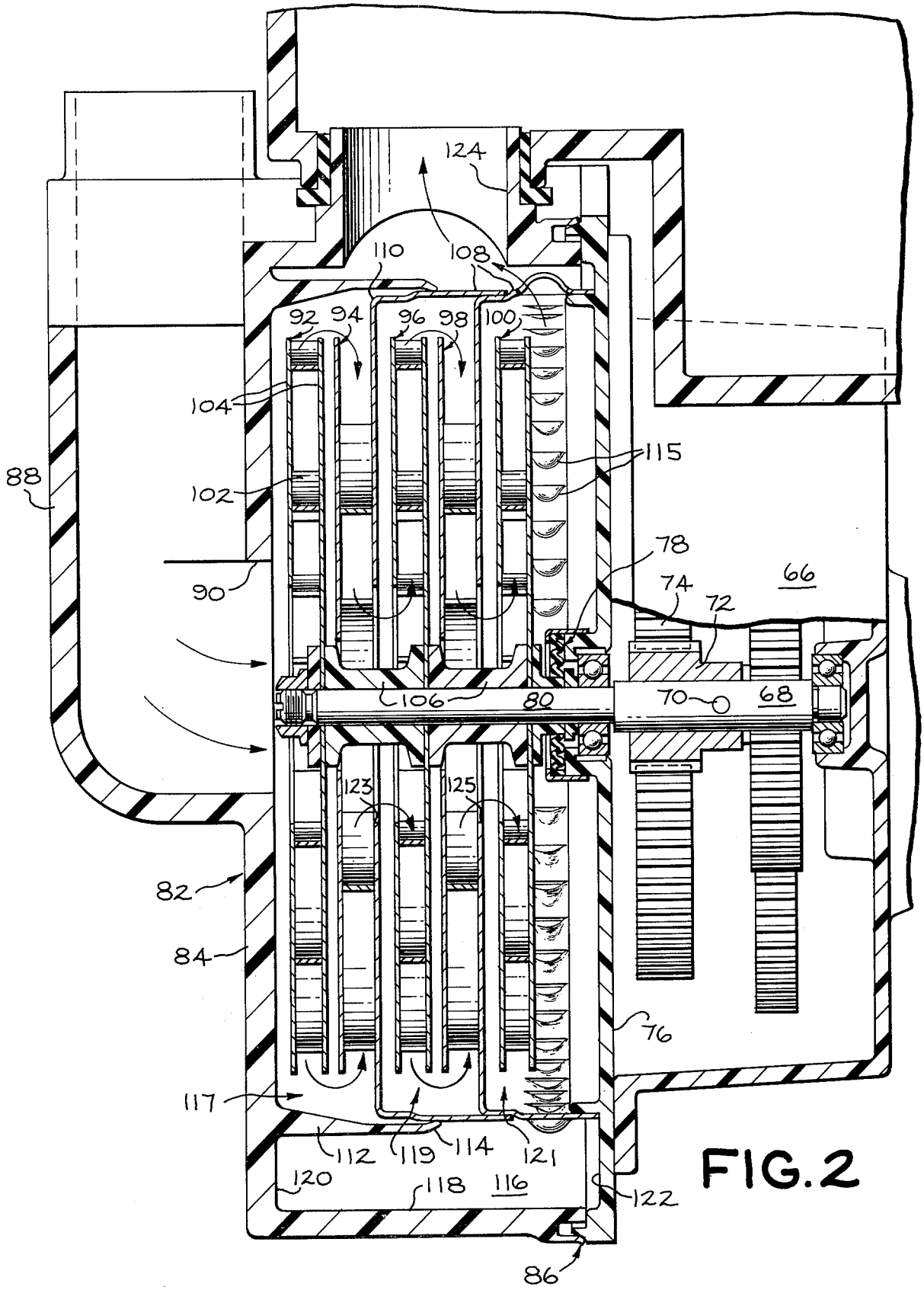
FIG. 2 is an enlarged cross-sectional view of the vacuum blower mechanism of the laundry machine of FIG. 1.

With reference to FIG. 2, a portion of the transmission 66 is shown that drives the vacuum blower 34. There is a shaft 68 secured, as by pin means 70, to a driven spur gear 72 having a smaller diameter than a driving external spur gear 74. The diameters of the spur gear 72 and driving spur gear 74 are such that the driven spur gear 72 is rotated at 13,800 revolutions per minute when an electric motor with a shaft turning at 3,450 revolutions per minute is utilized for the driving means. Rotatable shaft 68 extends through the rearward gear housing half 76 and is sealed by an assembly 78 to allow rotation of the shaft without oil leakage from within the transmission housing. The rearward portion 80 of shaft 68 is secured to blower wheels within the negative pressure producing means or vacuum blower 34 to thereby effect rotation of the wheels at the same revolutions per minute provided to the shaft 68, namely 13,800.

Figure 3:
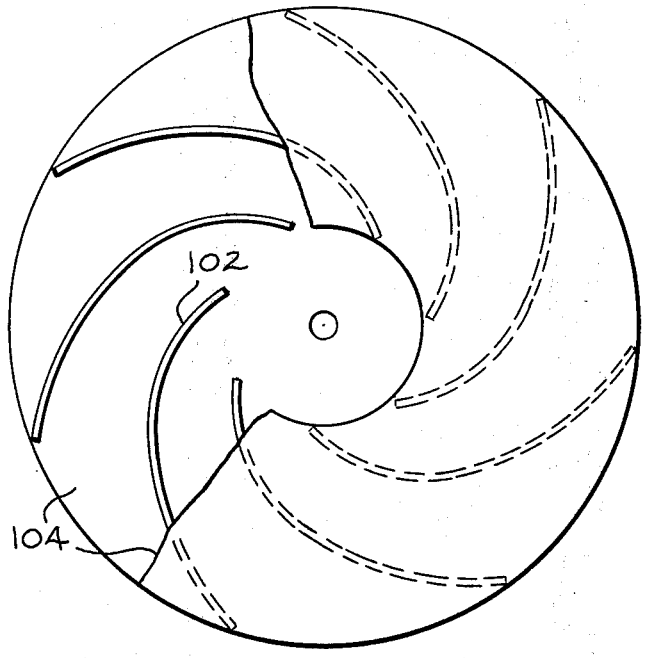
FIG. 3 is a front plan view, partially broken away, of one blower wheel of the vacuum blower mechanism.
Figure 4:
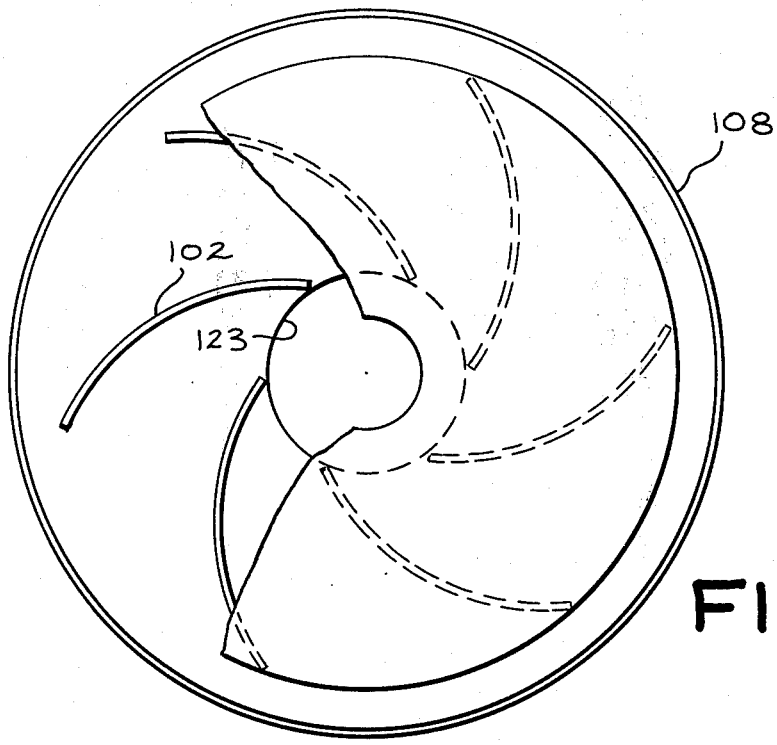
FIG. 4 is a front plan view, partially broken away, of another blower wheel with a surrounding shroud of the vacuum blower mechanism.

With reference particularly to FIGS. 2, 3 and 4, the structural arrangement of the vacuum blower 34 which includes the improvement invention will be discussed. The vacuum blower 34 has an outside housing 82 made up of a rearward housing portion 84 which is sealed against the rearward gear housing half 76. The sealing is circumferentially around the rearward housing portion 84 and is designated as area 86 where the housing portion 84 and gear housing half 76 mate and may be secured together by any suitable means. The housing portion 84 has a conduit section 88 which connects the hose 48 to the center of housing portion 84 which has an opening 90 for air to be introduced into the interior of the vacuum blower 34.

The interior of the vacuum blower 34 has a stack of spaced axially aligned blower wheels indicated as wheels 92, 94, 96, 98 and 100. All of these blower wheels have curved blades 102 which are sandwiched and held in place by flat discs 104. In the case of blower wheels 92, 96 and 100, their structure is as shown in FIG. 3. These blower wheels are secured to the rearward portion 80 of the driving shaft and may be suitably secured and spaced by bushings 106. Blower wheels 94 and 98 are similar in structure to the others, however, the one disc 104 is extended to form a peripheral wall or shroud 108 formed by a right angle bend 110. The peripheral wall 108 forms a portion of the interior air flow restricting wall of the blower. These peripheral walls 108 carry the blower wheels 94 and 98 so that the walls will rotate along with blower wheels and the rearward portion 80 of the driving shaft. To complete the confining interior air flow restriction wall there is a stationary depending circumferential flange 112 secured to and depending from the rearward housing portion 84. In the caase where the housing is molded from suitable plastic the flange 112 may be integrally molded with the rearward housing portion 84. The flange 112 is stationary while the shrouds 108 are rotating and contact the inwardly turned terminal end 114 of the flange 112.

The air flowing from conduit portion 88 through opening 90 is directed at the center of the first blower wheel 92 and the air flow through the successive five blower wheels is shown by arrows in FIG. 2. At the last stage of the blower the air leaves the interior of the blower through louvered slots 115 cut or otherwise formed in the peripheral wall 108 of blower wheel 98. This particular embodiment of the vacuum blower 34 is a multi-stage blower having three-stages meaning there are three chambers through which the air must pass and be acted upon by the blower wheels and thereby increase the air flow velocity. The first stage chamber 117 includes blower wheels 92 and 94, the second stage 119, blower wheels 96 and 98 and the third stage 121, blower wheel 100. The air flow leaves the first stage chamber 117 via opening 123 in blower wheel 94, then leaves the second stage chamber 119 via opening 125 in blower wheel 98 and the third stage 121 via louvered slots 115. It will be noted that the confining interior air flow restriction wall of the first stage chamber 117 is the stationary depending circumferential flange 112 while the restriction wall of the other two stage chambers are the rotating blower wheel shrouds 108.

Surrounding the vacuum blower interior is a peripheral walled circular chamber 116 formed on the inside by flange 112 and peripheral walls 108 of blower wheel 94 and blower wheel 98. The outside wall 118 is formed as part of blower housing rearward portion 84. The two end walls of the peripheral chamber are formed respectively by wall 120 also formed integrally with rearward housing portion 84 and the other end wall 122 being a circular portion of the rearward gear housing half 76. The shroud 108 of the next to last blower wheel 98 is provided with louvered slots 115, as mentioned above, which surround the last blower wheel 100. These slots provide an air flow passageway leading from the last blower wheel into the peripheral walled circular chamber 116 for introducing the high velocity air flow from the interior of the vacuum blower 32 into the peripheral chamber 116. The peripheral chamber 116 completely surrounds circumferentially the blower and has an air outlet 124 perpendicular to the axis of rotation of the blower wheels, for discharge of the air flow from the vacuum blower 34. In this case the air flows from the vacuum blower 34 into a muffler 55. The peripheral chamber arrangement provides for a substantially reduced noise level normally associated with this type of vacuum blower. Moreover, it is advantageous to make the peripheral chamber outside wall 118 of substantial thickness and preferably a plastic material to increase its sound deadening capability.

In the operation of the laundry machine means are provided for discontinuation of the operation of the vacuum blower 34 during the drying operation and the heated air flow through the machine is provided by the air blower 58 only. This can be accomplished by a suitable clutching mechanism to disengage driving external spur gear 74 from the motor shaft.

The foregoing is a description of the preferred embodiment of the invention and variations may be made thereto without departing from the true spirit of the invention, as defined in the appended claims.

What is claimed is:

1. In a multi-stage chamber type blower mechanism having a plurality of bladed rotatable blower wheels in axial alignment to produce an air flow, the improvement comprising:

a. a housing surrounding the blower wheels, b. an air inlet directed at the center of a first blower wheel, c. a peripheral walled chamber having an interior wall and an outer wall located circumferentially around all of the lower wheels, the first stage chamber having a stationary circumferential flange as an air flow restriction wall and the other stage chambers having rotating restriction walls, d. an air flow passageway leading from the last blower wheel into the peripheral walled circular chamber, and e. an air outlet from the peripheral walled circular chamber.

2. In the blower mechanism of claim 1, wherein the air outlet from the peripheral walled circular chamber is perpendicular to the axis of rotation of the blower wheels.

3. In the blower mechanism of claim 1, wherein the outer wall of the peripheral walled chamber is the surrounding housing.

4. In the blower mechanism of claim 1, wherein the stationary restriction wall of the first stage chamber and the rotating restriction walls form the interior wall of the peripheral chamber.

5. In the blower mechanism of claim 1, wherein the outer wall of the peripheral chamber and the stationary restriction wall of the first stage chamber are integrally molded from plastic material.

* * * * *

UNITED STATES PATENT OFFICE

CERTIFICATE OF CORRECTION

PATENT NO. : 3,963,370

DATED : June 15, 1976

INVENTOR(S) : Roy K. Yates; Charles T. Lutes

It is certified that error appears in the above-identified patent and that said Letters Patent are hereby corrected as shown below:

Column 6, line 19, eliminate "lower"

and substitute --blower--

Signed and Sealed this

Nineteenth Day of October 1976

[SEAL]

*Attest:*

RUTH C. MASON
*Attesting Officer*

C. MARSHALL DANN
*Commissioner of Patents and Trademarks*